US006089065A

United States Patent [19]

Dériaz

[11] Patent Number: 6,089,065

[45] Date of Patent: Jul. 18, 2000

[54] PROCESS AND ARRANGEMENT FOR THE COLD FORMING OF HOLLOW WORKPIECES

[75] Inventor: Daniel Dériaz, Meilen, Switzerland

[73] Assignee: Ernst Grob AG, Maennedorf, Switzerland

[21] Appl. No.: 09/198,450

[22] Filed: Nov. 24, 1998

[30] Foreign Application Priority Data

Nov. 24, 1997 [EP] European Pat. Off. ..... 97120547

[51] Int. Cl.[7] ..... B21H 5/02

[52] U.S. Cl. ..... 72/96; 72/106; 72/710

[58] Field of Search ..... 72/710, 96, 106

[56] References Cited

U.S. PATENT DOCUMENTS

| | | | |
|---|---|---|---|
| 3,455,139 | 7/1969 | Flowers et al. | 72/710 |
| 3,911,710 | 10/1975 | Gest | 72/192 |
| 5,765,419 | 6/1998 | Krapfenbauer | 72/96 |

FOREIGN PATENT DOCUMENTS

| | | | |
|---|---|---|---|
| 0 688 617 | 12/1995 | European Pat. Off. . | |
| 42 18 092 | 6/1993 | Germany . | |
| 2-006029 | 3/1990 | Japan . | |
| 615957 | 7/1978 | Russian Federation | 72/710 |
| 658 006 | 10/1986 | Switzerland . | |

OTHER PUBLICATIONS

European Search Report.

*Primary Examiner*—Lowell A. Larson
*Attorney, Agent, or Firm*—Evenson, McKeown, Edwards & Lenahan, PLLC

[57] ABSTRACT

A process and device for manufacturing cylindrical hollow bodies out of a blank through cold forming using roll cylinders is provided. The axes of the roll cylinders in this process are essentially adjusted parallel to the axis of the workpiece and execute, essentially radial to the workpiece, an oscillating, reciprocating movement. This reciprocating movement is executed in such a manner that in the upper oscillation stop the roll cylinders and the workpiece preferably just barely touch each other without the application of force, and in the lower oscillation stop preferably dip into the surface of the workpiece up to the desired infeed depth in order to achieve the demanded external diameter of the workpiece. With this process the very high static pressures required for press roll machines can be avoided, which results in small and light engine frames, and simultaneously makes it possible to machine workpieces with flanges directly up to the flanges.

18 Claims, 4 Drawing Sheets

PROCESS AND ARRANGEMENT FOR THE COLD FORMING OF HOLLOW WORKPIECES

BACKGROUND AND SUMMARY OF THE INVENTION

This application claims the priority of European Patent Application No. 97 120 547.1, filed Nov. 24, 1997, the disclosure of which is expressly incorporated by reference herein.

The present invention relates to a process for the cold forming of hollow workpieces with a circular cross section from workpiece blanks onto which, from the outside and by means of at least one forming tool in the shape of a roller, pressure or oscillation sequences are executed, in the course of which the workpiece, in relation to the roller, performs in the longitudinal axis a forward feed and is rotated. The invention also relates to an arrangement for the realization of the process.

Conventionally, for example, it is known to use press roll processes or impact roll processes for the cold forming of hollow pieces of such a kind.

During the press rolling, press rollers have a radial effect on a workpiece, which for example is arranged at the end of a spindle which is equipped with a matrix. As a result, the workpiece is rotated by the axially driven spindle and the press cylinders are pressed radially to the surface of the workpiece. Through an axial shift of the press cylinders in relation to the spindle and a radial infeed of the press cylinders, the desired shape of the workpiece is attained, in the course of which the internal shape is developed that corresponds to the matrix.

If hollow pieces are to be produced with an internal change of form, for example an internal toothing, a press roll process is known from German Patent document DE 4,218,092 for example, in which the thickness of the wall of the workpiece is reduced simultaneously with the change of form. Pressing and rolling are performed by means of a press cylinder, which is pressed onto the workpiece under high pressure and effects the forming. For the completion of this process, a high static pressure is necessary, which in turn requires a very stiff and heavy engine frame because the workpiece material and the workpiece blank must be rolled down by the press cylinder into the corresponding recess of the matrix. Depending on the internal shape that is to be created, this production process also causes strong vibrations, particularly in the areas where the wall thickness is thinnest, i.e., at those points where the internal wall of the hollow piece possesses grooves. For example, on one hand, this factor leads to the appearance of a great deal of wear and, on the other hand, leads in addition to a non-homogeneous external surface of the workpiece.

A cold forming process, which largely eliminates such disadvantages, is known for example from CH 658 006. This process is called an impact roll process, because in this case the force is not transferred to the workpiece statically by the press cylinders but instead by moving impact rollers, which are arranged on a roller head that rotates around its own axis on a rotary circular path. These impact rollers subsequently carry out abrupt, individual rolling on the cylindrical, hollow workpiece blank. As a result of this, the forces, in particular the static forces, can be kept at a lower level, which results in a smaller and lighter engine frame in comparison to the press roll devices. Now, a disadvantage of this approach can be, depending on the area of employment, that the large radius—conditional on the circular path of the impact roller—of the roller head, limits the kind of shapes that workpieces can have so that they can be machined with this process, for all practical purposes, to hollow bodies without externally projecting or respectively protruding flanges.

In order to reduce this problem, an impact roll process is now known from European Patent document EP 0 688 617, in which the impact roll processes are executed transversely to the axis of the workpiece. With this process, hollow pieces, which possess externally projecting shoulders or flanges, can now also be produced, as the thus arranged roller heads can be guided closer to the workpiece shoulder. Nevertheless, here in this case as well, there remains—as the result of the construction of the roller head in which the individual impact rollers run on bearings—a certain minimal space between the last section of the workpiece which can be reached by the impact rollers and its shoulder that cannot be machined.

The goal of the present invention is to provide a cold forming process with which such hollow pieces can be produced in a simple manner and which avoids the disadvantages and problems of the known processes, or at least reduces them.

This goal is achieved in accordance with the present invention by a process for the cold forming of hollow workpieces with a circular cross-section from workpiece blanks onto which, from the outside and by means of at least one forming tool in the shape of a roller, pressure or oscillation sequences are executed, in the course of which the workpiece, in relation to the roller, performs in the longitudinal axis a forward feed and is rotated on its longitudinal axis. The axes of the rollers are essentially guided parallel to the axis of the workpiece and are moved with an oscillating motion by an adjustable linear or curved oscillation.

It has been shown surprisingly that already the provision of a small reciprocating movement or respectively eccentricity of the rollers or roll cylinders significantly reduces the high static forces of the known press roll process, in the course of which, nevertheless, the good forming characteristics of the impact roll process are attained. In contrast to impact rollers, the rollers are not lifted off the workpiece, instead by preference they remain in contact with the surface of the tool. Simultaneously, the advantages of the press rolling can be utilized, such as for example the actuation of the press tools through the workpiece, as these are in contact with each other on their surfaces. Also of advantage is that the machine frame, as is known from impact roll machines, can be designed relatively small and light. Because, analogous to the press roll process, the roll tool is designed as one single roller and not one or more impact rollers run on bearings in the roller head, it is to the best advantage that with this process forming now can take place close to the externally projecting shoulder or flange, respectively, of a workpiece.

It is to the best advantage that analogously to the impact roll machines or systems, light machines can be realized which, in addition, require less space and can form workpieces that heretofore, because of the large radiuses of the impact rollers, were the exclusive domain of pure press roll machines or systems.

In accordance with the overall definition of the invention, the preferred designs of the process are further described herein.

An arrangement, in accordance with the present invention, for conducting the process includes a spindle for receiving a workpiece blank. Adjustable rollers with roll axes that are essentially placed parallel to the axis of the spindle are radially adjustable with respect to the workpiece. The device has means to perform a linear or circular oscillating, reciprocating movement, with adjustable oscillation of the axes of the rollers. Preferred designs of this device in accordance with the present invention are further described herein.

Other objects, advantages and novel features of the present invention will become apparent from the following detailed description of the invention when considered in conjunction with the accompanying drawings.

DETAILED DESCRIPTION OF THE DRAWINGS

Figure 1:
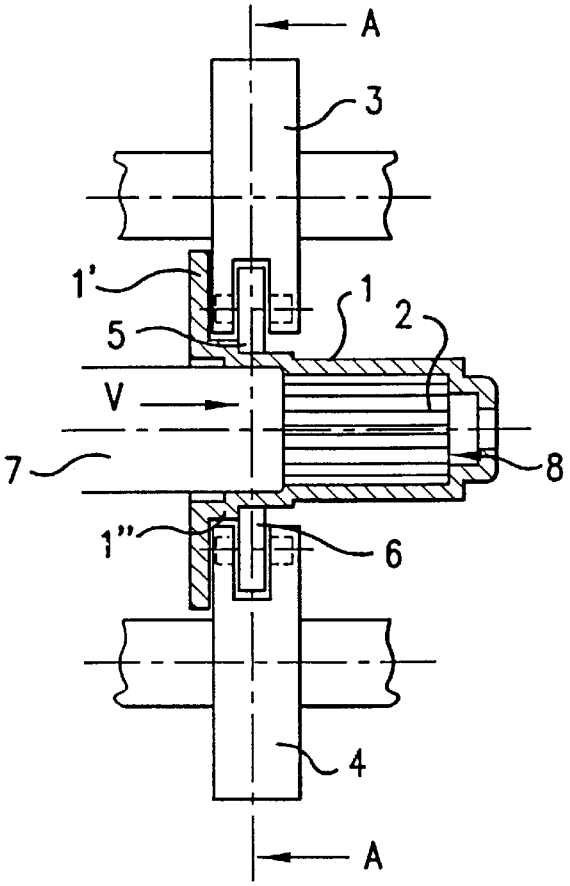
FIG.1 PRIOR ART
FIG. 1 is a longitudinal section view of a conventional impact roll device with impact roll processes that take a transverse course with respect to the axis of the workpiece.
Figure 2:
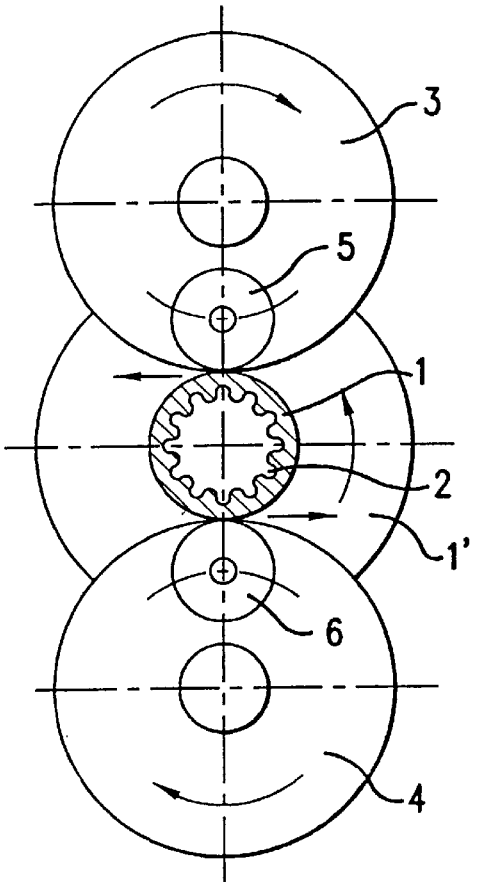
FIG.2 PRIOR ART
FIG. 2 is a cross section view of the roller heads and the workpiece taken in the direction A—A from FIG. 1.

In FIGS. 1 and 2, the longitudinal sections and cross sections of a conventional impact roll machine or system are depicted in the machining area of the workpiece, as is known from European Patent document EP 0 688 617. In the course of this process, the cylindrical workpiece 1 with internal toothing 2 is formed from a hollow workpiece blank, which is also cylindrical, through abrupt individual roll processes of impact rollers 5 and 6 respectively, which can be rotated and are run on bearings in the roller heads 3, 4. As a result of the abrupt individual roll processes that are executed from the exterior of the hollow workpiece, the material of the workpiece blank is cold formed and receives on its inner surface the shape of the device's matrix or mold 8, which is placed on or before, respectively, the forward feed arbor 7. With this process, for example, the internal toothing 2 of hollow pieces can be manufactured quickly and with a high degree of precision, in the course of which simultaneously a diameter reduction of the blank can be attained in which the material flows principally in the longitudinal direction, i.e., in the opposite direction to the forward feed direction V, as well as into the grooves of the matrix or mold 8. However, should the workpiece 1 now also possess a flange 1', then the impact roll processes cannot be guided directly up to this flange 1'; instead a shoulder 1" remains in the transition area to the flange 1' which cannot be machined. This circumstance is necessitated in terms of the construction by the arrangement of the roller heads 3 and 4 respectively. As a result of the arrangement of the bearings of the impact rollers 5 and 6 respectively in the roller heads 3, 4, the roller heads 3, 4 must necessarily be designed wider than the impact rollers 5, 6.

Figure 3:
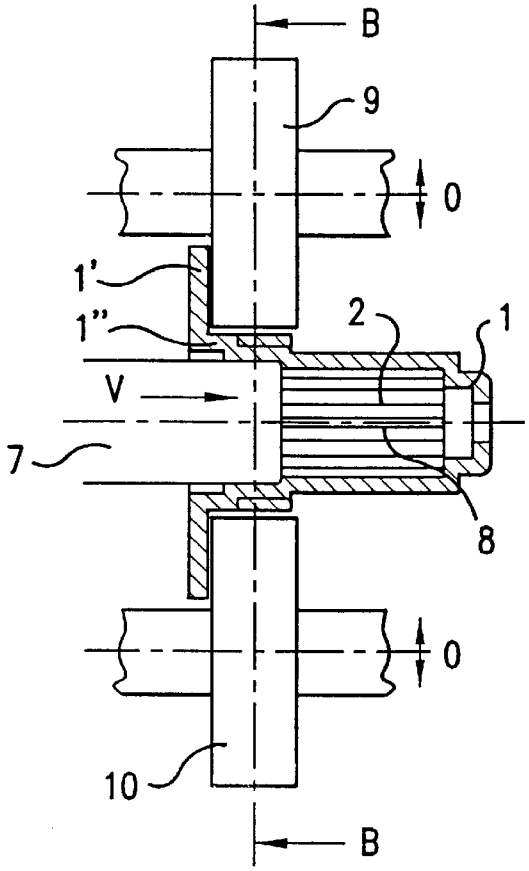
FIG. 3 is a longitudinal section view of a device in accordance with the present invention with a machined workpiece.
Figure 4:
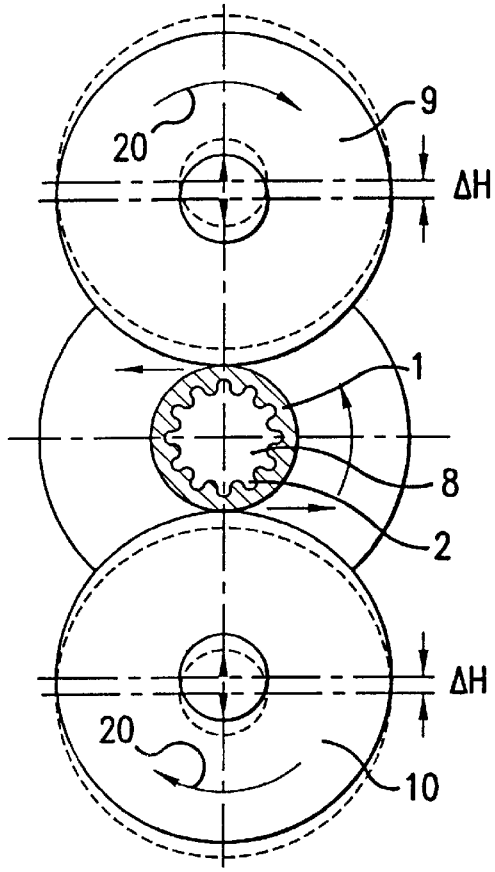
FIG. 4 is a cross section view of the area of the roll cylinders taken in the direction B—B from FIG. 3.

The device according to the present invention, as depicted in FIGS. 3 and 4 in schematic longitudinal and cross section views, can now eliminate this disadvantage. The workpiece 1 is shaped in a conventional manner over a matrix or mold 8 on or respectively in front of the forward feed arbor 7. In this workpiece, on the one hand, an internal toothing 2 is formed corresponding to the matrix 8, and if necessary, a diameter reduction of the original blank of the workpiece 1 is achieved, depending on the feed position of the rollers 9, 10. The rollers 9, 10, however, are now no longer run on bearings in a rotationally driven roller head, instead they are designed to rotate around their own axis exactly as is the case in conventional press roll engines. With this design, the rollers 9 and 10 respectively can be guided directly to the flange 1' of the workpiece 1, as a result of which non-machined shoulders are avoided. The shoulders 1" to be processed can be machined via the rollers 9 and 10 respectively in their entirety up to the flange 1'. In contrast to the conventional press rollers, in accordance with the invention, the rollers 9 and 10 respectively, however, are now not pressed against the workpiece 1 by means of a high static pressure, instead they are impinged upon via an oscillating movement O or ΔH, respectively, essentially in a perpendicular direction to the forward feed axis V of the workpiece 1. This takes place with an adjustable oscillation ΔH whereby preferably the rollers 9, 10 at the upper oscillation end are still only just in contact with the workpiece 1, practically pressureless, and at the lower oscillation end corresponding to the to be attained wall thickness dip into the material of the workpiece 1, corresponding to the radial infeed depth required for this.

The workpiece 1 is driven by its own actuation by the spindle 7. With this, the rollers 9 and 10 respectively are rotated in the direction of the arrows 20, through friction forces between the supporting surfaces of the workpiece 1 and the rollers 9 and 10 respectively. Moreover, the spindle 7 has an actuation in the forward feed direction V.

It is clear that in place of the depicted arrangement with two rollers 9, 10 that face each other, also any other force symmetrical arrangement of rollers, for example four rollers, is suitable for this process.

It has been shown, in accordance with the invention, that also this small oscillating, reciprocating movement O or ΔH respectively, in connection with the use of large rollers 9, 10 analogous to press rollers, achieves the same forming effect as the impact roll process described at the outset. In contrast to press rollers, the roller bodies 9, 10 do not need to be impinged upon with a very high static pressure, which requires a very stiff, large, and heavy engine frame and in addition very high forward feed forces, instead they can be attached to a relatively small and light frame.

Figure 5:
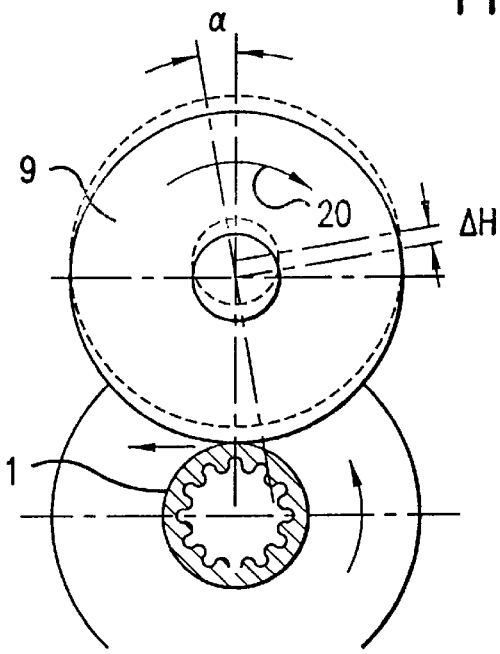
FIG. 5 is an additional cross section cutout view as in FIG. 4.

In a preferred embodiment, the reciprocating movement ΔH is not executed in exactly the same direction as the axis of the workpiece, but instead at an angle $\alpha$, preferably a sharp angle of between 0° and 5°, as schematically depicted in a cross section view in FIG. 5.

The inclined position of the oscillation axis ΔH with regard to the axis of the workpiece takes places against the direction in which the roller 9 rotates, which is indicated by the arrow 20 in FIG. 5.

Figure 6:
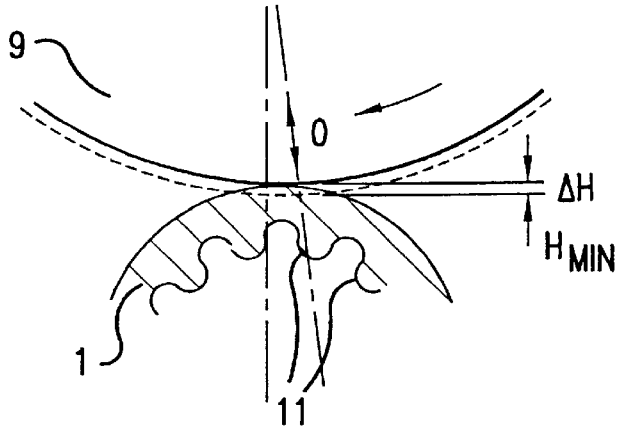
FIG. 6 is a detailed cross section cutout view from FIG. 5 in the lower oscillation position of the roller.
Figure 7:
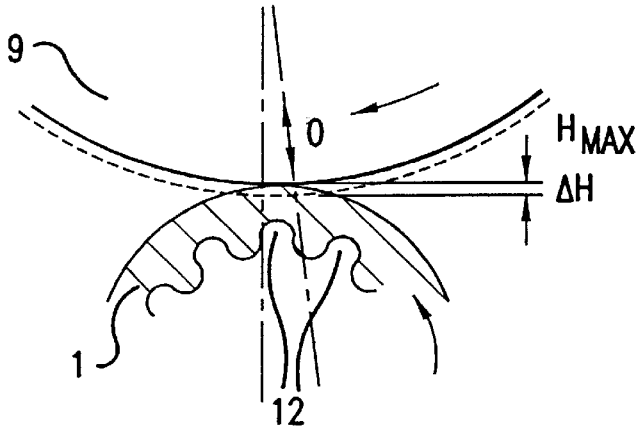
FIG. 7 is a cross section cutout view from FIG. 6 in the upper oscillation position of the roller.

The oscillation frequency is preferably adjusted in such a manner that the reciprocating movement in each case at least once, preferably however repeatedly, is executed in the areas of the teeth or respectively the tooth spaces of the internal toothing of the workpiece 1, as is depicted schematically in a cross section of the roller 9 in the FIGS. 6 and 7. In FIG. 6, the roller 9 is depicted in the lower, dipped oscillation stop $H_{min}$, which in this case falls on a tooth rib 11 of the workpiece 1. In FIG. 7, the roller 9 is depicted in the upper oscillation stop $H_{max}$, which for example falls on a tooth groove 12 of the workpiece 1. In this process, the oscillation frequency can be adjusted in such a manner that in each case multiple oscillations fall on each following tooth rib 11 or tooth groove 12 respectively, depending on the rotation speed of the rollers 9, 10 or the spindle 7 respectively, and the forward feed speed in the forward feed direction V of the workpiece 1.

The reciprocating movement of the rollers, which preferably face each other and are in this case the rollers 9 and 10, is executed simultaneously to take the best advantage of the arrangement, i.e., both rollers 9 and 10 respectively are at the same time at the lower and the upper oscillation stops.

Preferably, control mechanisms are provided which allow for a synchronization of the number of revolutions of the rollers, the oscillation frequency and oscillation distance, as well as the feed position of the rollers 9, 10 and the workpiece forward feed V, in order to be able to thus adjust the roll process to attain the desired internal toothing and surface finish.

Advantageously, with the processes and devices in accordance with the present invention, internally toothed hollow pieces 1 can be manufactured quickly and with a high degree of precision, in the course of which it is possible to machine pieces of this kind that have flanges 1' and to do so directly up to the flange 1'. In this process, the machines can be set up more easily in comparison to conventional press roll machines, and they can be operated with less force and thus with less expenditure of energy, because the forces can be specifically adjusted for the product which is to be produced.

Figure 8:
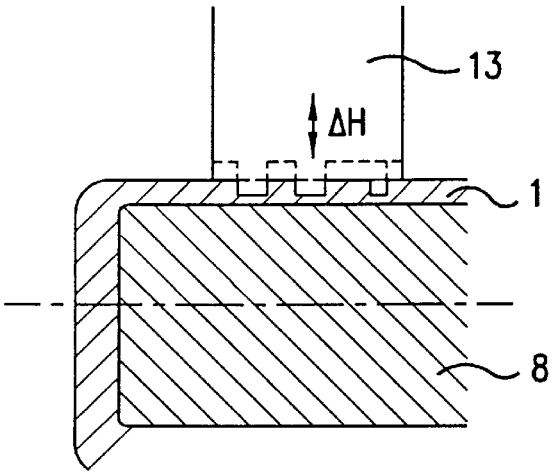
FIG. 8 is a longitudinal section view of a profiled roller.

A further advantage, in accordance with the present invention, consists of the fact that the rollers 9, 10 can, for example, be shaped as a roll cylinder 13 which possesses a profiled surface, as is schematically depicted in a longitudinal section view in FIG. 8. The roll cylinder 13 is employed in this case for supplying from the outside impressions, such as for example grooves and flutes, respectively.

Figure 9:
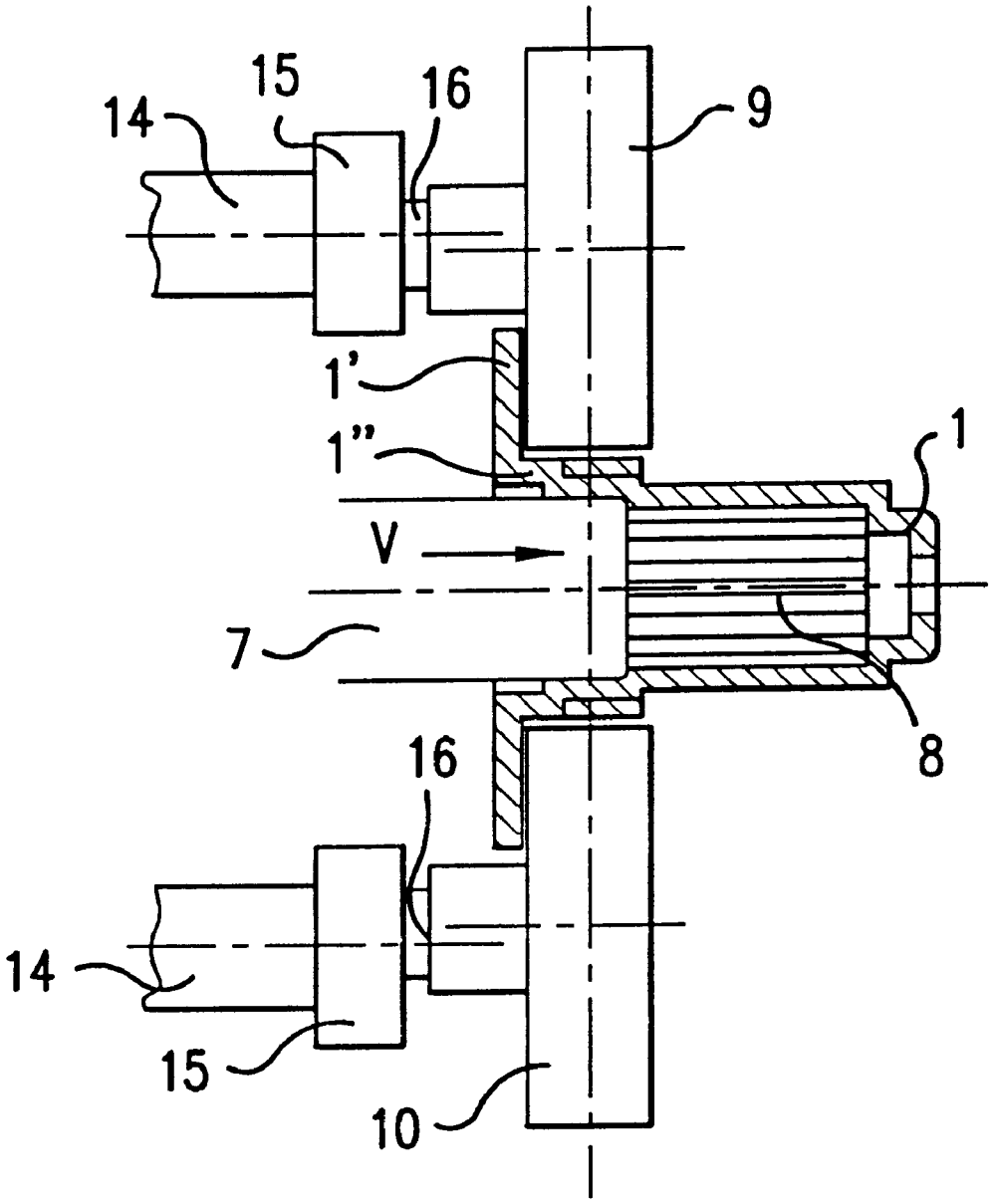
FIG. 9 is a longitudinal section view of a roll device in accordance with the invention with the rollers arranged on eccentric shafts.

The roll cylinders 9, 10 and 13 respectively can execute, instead of the linear reciprocating movements O, as in the previously depicted design examples, curved, for example elliptical or circular, reciprocating movements. A circular reciprocating movement can be realized in the most simple fashion by arranging the roll cylinders 9, 10 and 13 respectively at the end of an eccentric shaft 14, as is depicted in the longitudinal section in FIG. 9. Preferably, the eccentricity, which equals the oscillation ΔH, is adjustable, for example by means of hydraulic adjustment mechanisms arranged in the eccentric 15. By means of this, during the operation a simple resetting or adjustment respectively of the oscillation ΔH can be undertaken. One advantage of a curved reciprocating movement can be found in the fact that a tangential force component is transferred from the surface of the workpiece to the roll cylinders 9, 10 and 13 respectively. In such an arrangement, the eccentric shaft 14 is driven by a motor in a rotating motion, whereby the number of revolutions determines the oscillation frequency. The roll cylinders 9, 10 and 13 respectively are run free-rotating on bearings on the eccentric pin 16.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Process for cold forming a hollow workpiece having a circular cross-section from a workpiece blank having a workpiece surface which is exteriorly subjected to pressure by at least one forming tool, the process comprising the acts of:

advancing a workpiece along its longitudinal workpiece axis relative to the forming tool, and rotating the workpiece about its longitudinal workpiece axis; and maintaining a forming tool axis of the forming tool essentially in parallel to the longitudinal workpiece axis and, with respect to a distance to the longitudinal workpiece axis, moving the forming tool axis in an oscillating manner via an adjustable linear or curved stroke (ΔH);

wherein in an uppermost stroke position of the oscillating movement, the forming tool still maintains contact with the workpiece surface in an elastic area substantially without any pressure.

2. The process according to claim 1, wherein the forming tool is comprised of at least one roller.

3. The process according to claim 2, wherein the act of moving the forming tool axis in the oscillating manner is performed such that as a function of an internal toothing of the workpiece to be formed, the adjustable stroke is such that a lower stroke position falls at least once on a toothing rib of the workpiece.

4. The process according to claim 3, further comprising the act of using at least two rollers arranged mutually opposite one another; and wherein the adjustable stroke of each of the mutually opposite rollers is implemented synchronously such that the at least two rollers are synchronously moved substantially simultaneously into an upper and lower stroke position.

5. The process according to claim 2, wherein a stroke axis is aligned at an angle with respect to a line extending between the workpiece axis and the forming tool axis.

6. The process according to claim 5, wherein the angle is in a range of approximately 0° to 5°.

7. The process according to claim 5, further comprising the act of using at least two rollers arranged mutually opposite one another; and wherein the adjustable stroke of each of the mutually opposite rollers is implemented synchronously such that the at least two rollers are synchronously moved substantially simultaneously into an upper and lower stroke position.

8. The process according to claim 2, further comprising the act of using at least two rollers arranged mutually opposite one another; and wherein the adjustable stroke of each of the mutually opposite rollers is implemented synchronously such that the at least two rollers are synchronously moved substantially simultaneously into an upper and lower stroke position.

9. The process according to claim 2, wherein the adjustable stroke has a frequency which is a multiple of a rotational speed of the workpiece.

10. The process according to claim 1, further comprising the act of:

initially inserting a toothed die into the hollow workpiece for forming an internal toothing on an inner surface of the workpiece.

11. The process according to claim 10, further comprising the act of:

supplying a hollow workpiece having a flanged shoulder, wherein the advancing of the workpiece along its longitudinal workpiece axis relative to the forming tool is carried out directly up to the flanged shoulder of the workpiece, whereby the forming tool comprised of a roller shapes the workpiece directly up to the flanged shoulder.

12. An arrangement for cold forming a hollow workpiece having a circular cross-section from a workpiece blank having a workpiece surface, the arrangement comprising:

a spindle which receives the workpiece blank;

at least one roller which is radially adjusted relative to the workpiece blank and has a roller axis aligned substantially in parallel to an axis of the spindle; and an oscillator having an adjustable stroke for linearly or circularly moving the at least one roller toward the workpiece, such that the roller axis is maintained substantially parallel to the spindle axis, wherein the adjustable stroke is such that in an uppermost stroke position, the roller still maintains contact with the workpiece surface in an elastic area substantially without any pressure.

13. The arrangement according to claim 12, further comprising means for controlling in a coordinated manner the stroke movement with a number of revolutions of the roller.

14. The arrangement according to claim 13, wherein the roller is held in an adjustable eccentric device such that a stroke axis is aligned at an angle with respect to a line between the spindle axis and the roller axis.

15. The arrangement according to claim 13, further comprising at least two rollers arranged relative to the spindle axis so as to be capable of applying pressure or impacting a workpiece blank contained thereon; and a drive unit coupled to the spindle for advancing the spindle along its longitudinal axis relative to the mutually opposite rollers.

16. The arrangement according to claim 12, wherein the roller is held in an adjustable eccentric device such that a stroke axis is aligned at an angle with respect to a line between the spindle axis and the roller axis.

17. The arrangement according to claim 16, further comprising at least two rollers arranged relative to the spindle axis so as to be capable of applying pressure or impacting a workpiece blank contained thereon; and a drive unit coupled to the spindle for advancing the spindle along its longitudinal axis relative to the mutually opposite rollers.

18. The arrangement according to claim 12, further comprising at least two rollers arranged relative to the spindle axis so as to be capable of applying pressure or impacting a workpiece blank contained thereon; and a drive unit coupled to the spindle for advancing the spindle along its longitudinal axis relative to the mutually opposite rollers.

* * * * *